United States Patent [19]

Thorsen

[11] 4,433,555

[45] Feb. 28, 1984

[54] DEFROSTER FOR A REFRIGERATOR

[75] Inventor: Niels P. Thorsen, Sønderborg, Denmark

[73] Assignee: Danfoss A/S, Nordborg, Denmark

[21] Appl. No.: 447,180

[22] Filed: Dec. 6, 1982

Related U.S. Application Data

[63] Continuation of Ser. No. 270,094, Jun. 3, 1981, abandoned.

[30] Foreign Application Priority Data

Jun. 18, 1980 [DE] Fed. Rep. of Germany ..... 30227135

[51] Int. Cl.[3] ..... F25D 21/06

[52] U.S. Cl. ..... 62/154; 62/156

[58] Field of Search ..... 62/154, 156, 227

[56] References Cited

U.S. PATENT DOCUMENTS

| | | | |
|---|---|---|---|
| Re. 20,212 | 12/1936 | Raney | 62/154 |
| 2,095,014 | 10/1937 | Stark | 62/156 |
| 2,708,348 | 5/1955 | Philipp | 62/154 |
| 3,022,640 | 2/1962 | Hubacker | 62/156 |
| 4,169,358 | 10/1979 | Hansen et al. | 62/154 |

FOREIGN PATENT DOCUMENTS

| | | | |
|---|---|---|---|
| 2746627 | 2/1979 | Fed. Rep. of Germany . | |
| 611311 | 10/1948 | United Kingdom | 62/154 |

*Primary Examiner*—Albert J. Makay
*Assistant Examiner*—Harry Tanner
*Attorney, Agent, or Firm*—Wayne B. Easton

[57] ABSTRACT

The invention relates to refrigerator apparatus and particularly to the defrosting thereof. The thermostat is responsive to evaporator temperature and has first and second displacement ranges for respectively controlling the normal operation and the defrosting operation via first and second switches. A counter counts the cyclical operations of the first switch and at a predetermined count actuates an interrupter switch which is effective to block power to the compressor motor and direct power to the defroster heating apparatus. At a predetermined evaporator temperature the second switch is actuated which serves to reset the counter and this has the effect of ending the defrost cycle and returning the apparatus to normal operation under the control of the first switch.

2 Claims, 3 Drawing Figures

DEFROSTER FOR A REFRIGERATOR

This application is a continuation of Ser. No. 270,094, filed June 3, 1981, now abandoned.

The invention relates to a defroster for a refrigerator of which the evaporator thermostat has a main switching element for switching the compressor off at a switching-off temperature and for switching on at a higher switching-on temperature and operates at a still higher defrosting temperature to terminate the defrosting period, comprising a counting device which initiates the defrosting period after a predetermined number of switchings.

In a known defroster of this kind (DE-PS No. 26 55 315), the counting device comprises a ratchet wheel which is progressively operated by an electromagnet of which the coil is disposed in the electric circuit of the compressor or by a bimetallic strip which is heatable by a resistor in parallel with the evaporator thermostat switching element. The actuating element of the evaporator thermostat is subjected to a main spring and to an oppositely acting differential spring. After each rotation of the ratchet wheel, a blocking lever is actuated which receives the force of the differential spring so that only the main spring is effective, i.e. the evaporator thermostat switches the compressor on again only at a higher defrosting temperature. In addition, it is possible, simultaneously with actuation of the blocking lever, to actuate a switch which applies voltage to a defrosting heating resistor.

In this construction, the blocking lever must be robust to receive the forces of the differential spring. The counting device must be designed so that it can mechanically adjust this blocking lever. This, again, requires a comparatively strong drive. Further, the blocking lever alone takes up much space let alone the lever in conjunction with such a counting and driving device.

An evaporator thermostat for refrigerators is also known (DE-PS No. 27 46 627) which exhibits a pressure jump in the pressure-displacement graph, the operating point associated with the switching-on temperature being disposed on one side of the jump and the operating point associated with the switching-off temperature being disposed on the other side of the jump. For this purpose two springs act on the actuating element of the evaporator thermostat against the force of the temperature dependent pressure generator, of which the first is arranged between a setting device for fixing the one operating point and a coupling position and the second is disposed between the coupling position and the actuating element, the coupling position co-operating with a stationary first abutment when the pressure is higher than a first value and with an abutment on the actuating element when the pressure is lower than a second value higher than the first value. In this case the switching-on as well as the switching-off operating point can be disposed on comparatively flat branches of the graph and therefore be very accurately adjusted although an adequate temperature difference exists between the switching-on and switching-off operating point.

The invention is based on the problem of providing a defroster of the aforementioned kind in which a blocking lever and the associated actuating mechanism can be dispensed with to carry out defrosting.

This problem is solved according to the invention in that the evaporator thermostat comprises an auxiliary switching element which is actuated after an excessive displacement corresponding to the defrosting temperature and that to switch off the compressor there is a further interrupter switching element which can be brought to the blocked condition at the start of the defrosting period in response to the counting device and to the conducting condition at the end of the defrosting period in response to actuation of the auxiliary switching element.

In this construction, it is not necessary for a blocking element actuated by the counting device to engage in the spring system of the evaporator thermostat because attainment of the defrosting temperature is indicated by the auxiliary switching element which is actuated after execution of an excessive displacement. It therefore suffices to operate an interrupter switching element for the compressor on commencement of the defrosting period in response to the counting device and at the end of the defrosting period in response to actuation of the auxiliary switching element. Such an interrupter switching element does not call for large actuating forces. With direct mechanical operation small counting devices with a correspondingly small drive are sufficient. The actuation can also be electromagnetically. The switching element may also be electronic. Further, it is possible to dispense with a mechanical counting device and to construct same electrically or electronically. Altogether, the defroster can therefore be smaller and simpler than hitherto.

It is favourable if the interrupter switching element can be brought to the blocked condition in response to a predetermined count of an electronic counter and the counter can be switched to a different count by actuating the auxiliary switching element. In particular, the counter should be returnable to zero by actuating the auxiliary switching element. Electronic counters of this kind are available as small constructions in the form of integrated switching circuits. Since electric signals can be utilized on the input and output sides, there is further simplification and a space-saving construction.

Further, the counter may be operable by pulses derivable from the main switching element or auxiliary switching element. This is a particularly simple way of obtaining the counting pulses.

In a preferred embodiment, a defrosting heating resistor is in parallel with the interrupter switching element. When using such a heating resistor, one therefore does not require an additional switching element.

In a preferred embodiment, it is ensured that the evaporator thermostat exhibits a pressure jump in the pressure-displacement graph and the switching positions associated with the switching-on and off temperature are disposed on one side of the jump and the switching position associated with the defrosting temperature is disposed on the other side of the jump. By utilizing the jump, one can keep the excessive displacement small even if there is a larger difference between the defrosting temperature and the normal switching-on temperature.

From a constructional point of view, this can be achieved in that two springs act on the actuating element of the evaporator thermostat against the force of the temperature dependent pressure generator, of which the first is disposed between a setting device for fixing the normal switching function and a coupling point and the second is disposed between the coupling point and the actuating element, the coupling point co-operating with a stationary first abutment when the pressure is higher than a first value and with an abutment on the actuating element when the pressure is lower than a second value which is higher than the first value.

The invention will now be described in more detail with reference to a preferred example illustrated in the drawing, wherein.

Figure 1:
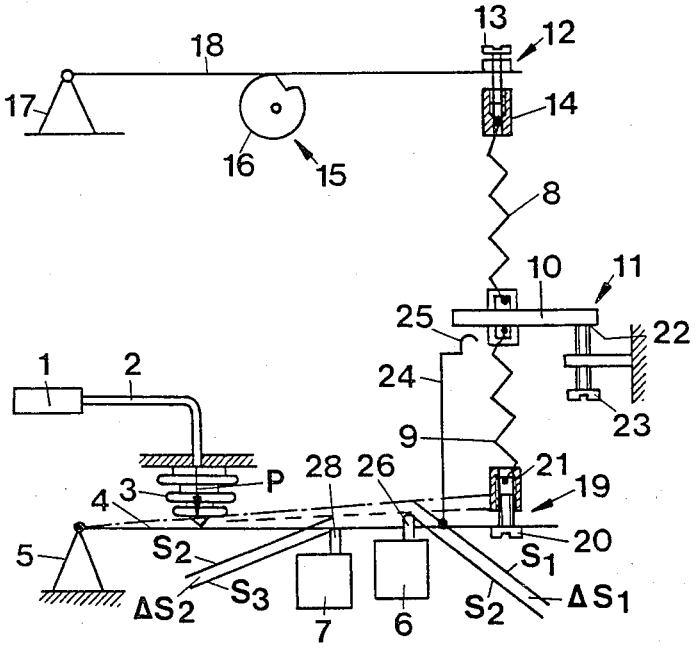
FIG. 1 is a diagrammatic representation of the mechanical construction of an evaporator thermostat according to the invention.
Figure 2:
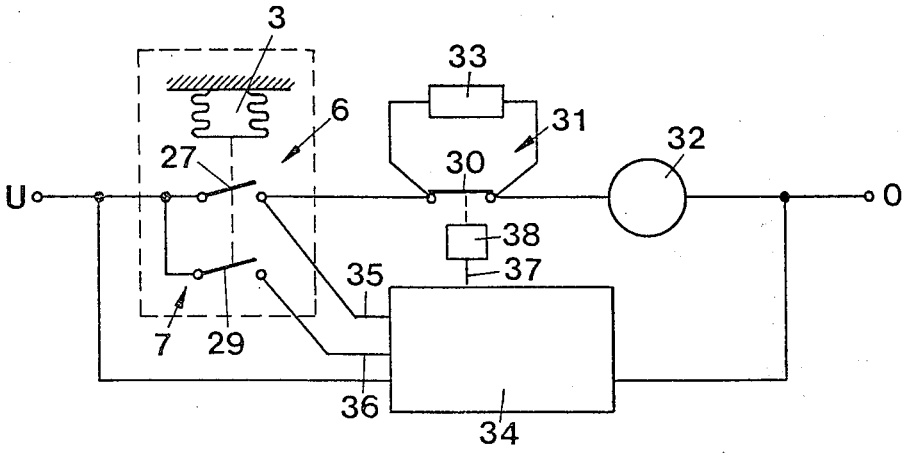
FIG. 2 is a block diagram showing the electric connection of the defroster to a compressor and FIG. 3 is an associated diagram showing the relationship between the measured temperature t, the pressures p occurring and the distance s covered by the actuating element.

A sensor 1 having a liquid-vapor filling is connected to an operating element 3 by way of a capillary tube 2. The vapour pressure p acting therein gives rise to a force which acts on an actuating element 4 in the form of a swing arm pivotable about a hinge 5. The arm acts on a main switching element 6 and an auxiliary switching element 7, both in the form of micro-switches.

Further, a selected one of two springs 8 and 9 acts on the actuating element 4 against the vapour pressure p. The first spring 8 extends between a coupling member 10 defining a coupling point 11 and an adjusting device 12 consisting of an adjusting screw 13 and an associated nut 14 to the end of which the spring 8 is secured. The adjusting device is seated at the end of a setting device 15 which consists of a cam plate 16 and a swing arm 18 pivotable about a stationary bearing 17. The second spring 9 extends between the coupling member 10 and an adjusting device 19 comprising an adjusting screw 20 extending through the actuating element 4 and an associated nut 21 secured to the spring 9.

The coupling member 10 co-operates with a stationary first abutment 22, here formed by a set screw 23, when the pressure p exceeds a predetermined first value p1. On the actuating element 4 there is a bar 24 with a second abutment 25 against which the coupling member 10 lies when the pressure p falls below a predetermined second pressure value p2.

The main switching element 6 is arranged so that the associated tappet 26 opens a switch 27 in a first switching position s1 corresponding to the chain-dotted position of the actuating element 4 and closes same in a second switching position s2 corresponding to the broken-line position of the actuating element 4. This corresponds to the switching path Δs1 traversed during normal operation. The auxiliary element 7 is arranged so that its tappet 28 closes a normally open switch 29 when the actuating element 4 has moved out of the switching position s2 through a further switching path Δs2 to reach the switching position s3.

The contact 27 of the main switching element 6 is in series with a contact 30 of an interrupter switching element 31 and the motor 32 of a refrigerator which supplies refrigerant to the evaporator monitored by the temperature sensor 1. A single phase alternating voltage can have its phase applied to the terminal U and its earth applied to the terminal O. The contact 30 of the interrupter switching element 31 bridges a heating resistor 33 which can assist defrosting of the evaporator. A conventional electronic counter 34 has a pulse input 35 for progressive switching and a resetting input 36 with the aid of which it can be returned to zero. An output 37 is connected to an amplifier element 38, e.g. a relay, which is adapted to actuate the contact 30.

Figure 3:
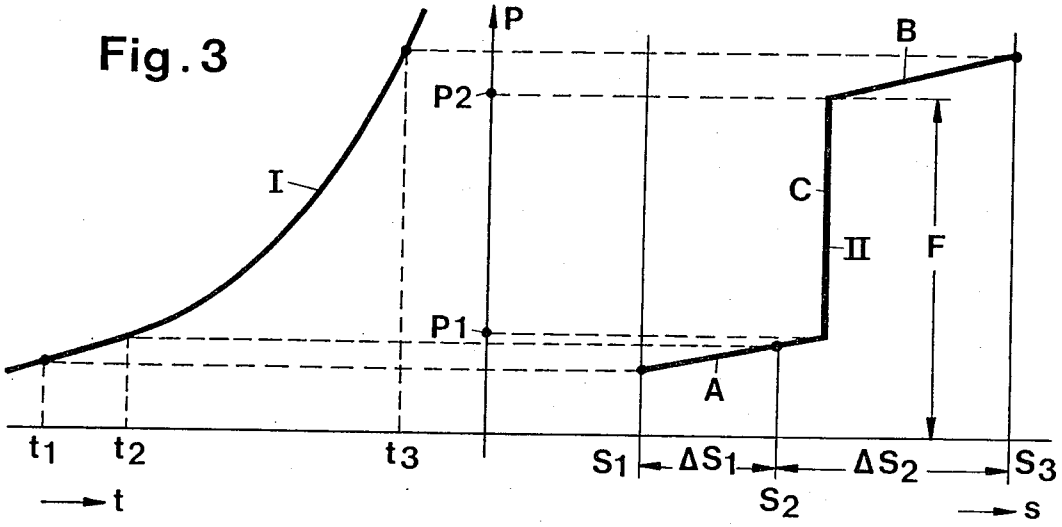

This leads to the following manner of operation explained with reference to FIG. 3. A vapour pressure curve I shows the relationship between the temperature t measured by the sensor 1 and the pressure P obtaining in the operating element 3. The force-displacement graph shows a combined spring characteristic II which consists of three sections, namely two flat sections A and B as well as a jump C. The seciton A depends only on the first spring 8 and the section B depends only on the second spring 9. The jump C is obtained because the spring 8 is made inoperative by the first abutment 22 and the spring 9 has prestressing F corresponding to the pressure value p2.

By inspecting both diagrams together, it will be seen that the motor 32 is normally switched off when the evaporator temperature reaches the value t1, corresponding to the switching position s1. The motor 32 is normally switched on at the evaporator temperature t2, corresponding to the switching position s2. If, however, switching-on of the motor 32 is prevented by opening the interrupter switching element 31, the evaporator temperature rises to the value t3, corresponding to the switching position s3.

During normal operation, a pulse is always fed to the pulse input 35 of the electronic counter when the switch 27 is opened. On reaching a predetermined count, which may be adjustable, a signal appears at the output 37 with the aid of which the interrupter switching element 31 moves to the blocked condition. The heating resistor 33 is thereby supplied with voltage and the motor 32 cannot start even if with the now rising evaporator temperature the switch 27 is closed in the switching position s2. Only when the defrosting temperature t3 has been reached and the switch 29 closes will the counter 34 be returned to zero, whereby the signal disappears at the outlet 37 and the interrupter switching element 31 returns to the conductive condition. The motor 32 now again starts to run and the refrigerator operates normally, the evaporator temperature changing nearly between the values t1 and t2.

The mechanical construction resulting in the jump C permits one to select the defrosting temperature t3 to have a comparatively large spacing from the evaporator temperatures t1 and t2. However, it is also possible to make do with a single spring and to choose all three operating points on its characteristic curve.

By turning the setting device 15, one can set the evaporator temperatures t1 and t2. The adjusting device 12 permits initial adjustment. By resetting the abutment 22, one can displace the jump C along the abscissa, for example if the switching position s2 is to be displaced to the right. The defrosting temperature can be set with the aid of the adjusting device 19.

I claim:

1. Refrigeration apparatus comprising, a compressor motor, an evaporator temperature monitoring sensor, defrosting heating means, actuator means responsive to the temperature of said sensor having first and second displacement ranges with first and second limiting positions corresponding to predetermined lower and upper temperatures, first and second switch means sequentially operated by said actuator means at said lower and upper temperatures, said first switch means being in series with said motor and being cyclically operable within said first displacement range, said second switch means operated by said actuator means at said upper limiting position, counter means having a counting input connected to said first switch means and a reset input connected to said second switch means, interrupter switch means in series with said first switch means and said motor, said counter means being operable to open said interrupter switch means to stop said motor and activate said defrosting heating means after the occurrence of a predetermined count on said counting input, and said counter means being resettable upon said reset input thereof being activated by said second switch means to close said interrupter switch means to start said motor and deactivate said defrosting heating means.

2. Refrigeration apparatus according to claim 1 including resilient means for controlling the displacement of said switch actuator means comprising first and second springs and coupling means connecting said springs, said first spring being connected to first fixed abutment means and said second spring being connected to said switch actuator means, said first spring being arranged to be more yieldable than said second spring to be effective for controlling said switch actuator first displacement range, a second fixed abutment engageable with said coupling means to provide a fixed limit for said switch actuator means first displacement range and to allow said second spring to be effective for controlling said switch means second displacement range.

* * * * *